US006947677B2

(12) United States Patent
Uyama et al.

(10) Patent No.: US 6,947,677 B2
(45) Date of Patent: Sep. 20, 2005

(54) IMAGE FORMING APPARATUS WITH DEVELOPING APPARATUS AND METHOD THEREOF

(75) Inventors: Masao Uyama, Shizuoka (JP); Masahide Kinoshita, Shizuoka (JP); Atsushi Numagami, Kanagawa (JP); Kazunari Murayama, Shizuoka (JP); Seiji Yamaguchi, Shizuoka (JP); Takahito Ueno, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/370,489

(22) Filed: Feb. 24, 2003

(65) Prior Publication Data

US 2003/0161643 A1 Aug. 28, 2003

(30) Foreign Application Priority Data

Feb. 26, 2002 (JP) ..... 2002-050374
Oct. 29, 2002 (JP) ..... 2002-314788

(51) Int. Cl.[7] ..... G03G 15/08
(52) U.S. Cl. ..... 399/27; 399/30
(58) Field of Search ..... 399/27, 30, 61–64

(56) References Cited

U.S. PATENT DOCUMENTS 5,311,261 A * 5/1994 Nakagama et al. ..... 399/63
5,909,603 A 6/1999 Suzuki et al. ..... 399/13
6,055,388 A * 4/2000 Watanabe et al. ..... 399/61
6,324,369 B1 11/2001 Yamaguchi et al. ..... 399/254
6,381,419 B1 4/2002 Kinoshita et al. ..... 399/27
6,389,250 B1 5/2002 Numagami et al. ..... 399/111
6,421,516 B1 7/2002 Kinoshita et al. ..... 399/254
2002/0025173 A1 2/2002 Isobe et al. ..... 399/12
2002/0146252 A1 10/2002 Yamaguchi ..... 399/30
2003/0021609 A1 1/2003 Yamaguchi et al. ..... 399/27

FOREIGN PATENT DOCUMENTS

JP 60263974 A * 12/1985 ..... G03G/15/08
JP 03256082 A * 11/1991 ..... G03G/15/08

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

The image forming apparatus has a developer container containing a developer therein, a developer toner density detecting portion for detecting the permeability of the developer in the developer container to thereby detect toner density, and an engine controller for detecting whether the image forming apparatus has gone wrong, on the basis of the toner density detected by the developer toner density detecting portion. Thereby, it becomes possible to detect the failure of a developing apparatus reliably and early by an inexpensive construction.

18 Claims, 6 Drawing Sheets

IMAGE FORMING APPARATUS WITH DEVELOPING APPARATUS AND METHOD THEREOF

BACKGROUND OF THE INVENTION

1. Field of the Invention

This invention relates to an image forming apparatus such as a printer, a copying machine, a facsimile apparatus or a compound machine thereof in which an electrostatic latent image formed on an image bearing member on the basis of an electrophotographic process corresponding to a recorded image to be recorded is developed with a developer and is recorded on a transfer material or the like, and a method of controlling the image forming apparatus.

2. Related Background Art

An image forming apparatus adopting the electrophotographic process is generally designed such that a toner which is a charged developer is caused to adhere to an electrostatic latent image formed on the surface of an image bearing member to thereby form a toner image, and the toner image is transferred to transfer paper conveyed so as to contact with the image bearing member, and the transfer paper is subjected to a heat fixing process to thereby fix the toner image on the transfer paper, thus completing an image forming operation.

In this case, as the developer, use is generally made of a toner mixed with powder having magnetism which is called a carrier. Of the developer, the toner is charged in a developing apparatus so as to be attracted to the electrostatic latent image on the surface of the image bearing member.

Thus, when an image forming process is carried out, the toner in the developer is decreased. The image forming apparatus is usually provided with a developer toner density detecting portion for detecting the toner density of the developer. The developer toner density detecting portion, when the residual amount of toner in a developer container provided in the developing apparatus has become a predetermined amount or less, is adapted to detect that the residual amount of toner is small, so as to cause a toner supplying apparatus to perform a toner supplying operation by control means.

As described above, in the conventional image forming apparatus, it has been necessary to detect the toner density of the developer at a suitable time by the developer toner density detecting portion so that by automatic toner replenishment control means (ATR) for effecting appropriate toner replenishment in conformity with the fluctuation of the toner density, the toner density may always be kept within a predetermined allowable range relative to a predetermined reference value.

Now, the ATR is generally comprised of toner density detecting means for detecting the toner density of the developer, toner replenishment amount control means for processing the output data of this toner density detecting means and determining a toner replenishment amount, and toner supplying means for actually supplying the toner on the basis of the toner replenishment amount determined by this toner replenishment amount control means.

Particularly, various types of toner density detecting means have been put into practical use. The toner density detecting means include, for example, a toner density detecting device by an optical sensor utilizing the fact that the light reflectance of a developer in a developer container or on a developer bearing member is varied by the toner density, a toner density detecting device by a permeability sensor for converting the permeability of a developer into an electrical signal by utilizing the fact that the permeability of the developer is varied by the toner density, a toner density detecting device for detecting a variation in the light reflectance of a predetermined patch image formed on an image bearing member under a predetermined condition to thereby indirectly estimate the toner density of a developer, etc.

In an image forming apparatus of a type which forms a digital latent image on an image bearing member by the use of a laser scanner or an LED array, the amount of toner consumption per page can be relatively accurately estimated from the total value (video count number) of the number of print pixels in an image information signal per page and therefore, this is also known automatic toner replenishment control means (hereinafter referred to as the "video count ATR) of a type which determines a toner replenishment amount correspondingly to this estimated consumption amount.

This video count ATR does not require a developer toner density detecting portion and therefore has the great advantage that the cost thereof can be reduced. This video count ATR, however, suffers from the problem that the error of the toner replenishment amount is gradually accumulated, and requires some means for correcting this and at present, it is difficult to use it singly.

On the other hand, in case where the developer toner density detecting portion is installed in the developing apparatus, the downsizing of the developing apparatus has been desired. Accordingly, the toner density detecting device by the permeability sensor is often selected and used in an automatic toner replenishment control apparatus because it requires only an installation space for the permeability sensor as the developer toner density detecting portion and is of a construction advantageous for downsizing.

This permeability sensor is installed in a portion of a developer conveying path or the like in the developing apparatus in order that the head portion of the permeability sensor including a coil which is a detecting portion may always contact with the developer. The permeability sensor has a detecting coil, which is constituted by a transmitting winding and a detecting winding. Design is made such that a high frequency transmission output is applied to the transmitting winding which is the transmitting portion of the detecting coil in the head, whereby the inductance of the detecting winding is varied in conformity with a variation in permeability conforming to the density of the developer present around the head, and therefore by measuring a variation in the inductance, it is possible to convert the permeability of the developer present around the head into an electrical output value (a voltage value).

Also, the above-described permeability sensor is generally installed in opposed relationship with a developer conveying member rotated to thereby convey the developer. Accordingly, the voltage output value detected from the permeability of the developer fluctuates with the rotation of the developer conveying member. Consequently, when representing the voltage output value detected from the permeability of the developer, use is generally often made of the average value of the output voltage value from the permeability sensor in one full rotation of the developer conveying member. The control of the amount of toner supply to the developing device is effected in conformity with this average value and a toner density reference value.

Now, the conventional developing apparatus has been of a construction in which a foreign substance intervenes between gears which constitute the drive transmitting means of the developing apparatus, whereby the gears which constitute the drive transmitting means of the developing apparatus are damaged, or in which because of the absence of means for detecting a failure state such as the locking of the bearing portion of the developer conveying member, the failure is difficult to notice. Also in the image forming apparatus, design is not made such that in the case that the failure as described above occurs, whereby the torque of a motor for driving the gear of the developing apparatus becomes great, the greatness of the torque is detected. Therefore, even when failure occurred for example, to the motor itself, it could not be detected early. As described above, design is not made such that the failure state of the developing apparatus is detected and therefore, the failure of the developing apparatus is found in some time after printing has been effected and a bad image or the like has occurred and therefore, it has been delayed for a user to notice the failure.

When any failure as described above occurs, the rotation of the developer conveying member stops and the fluctuation of the output voltage value detected from the permeability sensor becomes null and thus, the permeability sensor continues to output a certain constant value.

When this constant value is greater than an average value (the reference value of the toner density, the permeability sensor continues to output a signal so as to replenish the toner supplying apparatus with the toner. In this case, a great amount of toner is supplied from the toner supplying apparatus into the developer container. Accordingly, when such failure as the damage of the gears constituting the drive transmitting means of the developing apparatus, the locking of the bearing portion of the developer bearing member or the locking of the bearing portion of the developer conveying member occurs, the great amount of toner in the developer container is wasted. Also, when a developing apparatus driving motor which is the drive transmitting means of an image forming apparatus main body goes wrong, if the image forming apparatus resumes its image forming operation after the repair of the motor or the like on the image forming apparatus main body side, the toner density in the developer has become abnormally great, and this has sometimes led to the occurrence of the phenomenon called "fogging" that the toner adheres to a imaged portion to be imaged, the occurrence of a bad image such as the scattering of the toner and in the worst case, the unusability of the developing apparatus.

Also, when the above-mentioned constant value is smaller than the average value (reference value of the toner density), the permeability sensor continues to output a signal so as not to replenish the toner supplying apparatus with the toner at all. In this case, the toner supplying apparatus stops replenishing the developer container with the toner and thus, the toner in the developer container becomes null. Accordingly, when the developing apparatus motor which is the drive transmitting means of the image forming apparatus main body goes wrong, if after the repair of the motor or the like on the image forming apparatus main body side, the image forming apparatus resumes its image forming operation in that state, the toner density in the developer has become abnormally small and therefore, the toner is suddenly supplied from the toner supplying apparatus into the developer container, and this has sometimes led to the occurrence of a bad image such as fogging or the scattering of the toner.

SUMMARY OF THE INVENTION

It is an object of the present invention to provide an image forming apparatus in which toner density in a developing apparatus is controlled by the use of a toner density sensor and which enables the failure of the developing apparatus to be detected inexpensively, reliably and early, and a method of controlling the same.

It is another object of the present invention to provide an image forming apparatus having a developing apparatus having a developer container containing therein a developer including a toner and a carrier and density detecting means for detecting the permeability of the developer in the developer container to thereby detect the density of the toner, and control means for controlling the density of the toner in the developer container on the basis of the toner density detected by the density detecting means, wherein the control means judges the failure of the developing apparatus on the basis of the toner density detected by the density detecting means.

It is a further object of the present invention to provide an image forming apparatus having a developing apparatus having a developer container containing a developer therein, density detecting means for detecting the density of the developer in the developer container, and a developer agitating member for rotating and circulating the developer in the developer container, and control means for controlling the density of the developer in the developer container on the basis of the developer density detected by the density detecting means, wherein the control means judges the failure of the developing apparatus on the basis of the developer density detected by the density detecting means while rotating the developer agitating member by a predetermined number of revolutions.

It is a further object of the present invention to provide a control method of controlling an image forming apparatus having a developing apparatus having a developer container containing therein a developer including a toner and a carrier, and density detecting means for detecting the permeability of the developer in the developer container to thereby detect the density of the toner, and control means for controlling the density of the toner in the developer container on the basis of the toner density detected by the density detecting means, the control method having the step of detecting the toner density in the developer container by the density detecting means, and the step of judging the failure of the developing apparatus on the basis of the toner density detected by the density detecting means.

It is still a further object of the present invention to provide a control method of controlling an image forming apparatus having a developing apparatus having a developer container containing a developer therein, density detecting means for detecting the density of the developer in the developer container, and a developer agitating member for rotating and circulating the developer in the developer container, and control means for controlling the density of the developer in the developer container on the basis of the developer density detected by the density detecting means, the control method having the step of detecting the density of the developer in the developer container by the density detecting means while the developer agitating member is rotated by a predetermined number of revolutions, and the step of judging the failure of the developing apparatus on the basis of the developer density detected by the density detecting means.

Other objects and aspects of the invention will become apparent from the following description of an embodiment when read with reference to the accompanying drawings.

DESCRIPTION OF THE PREFERRED EMBODIMENTS

Figure 1:
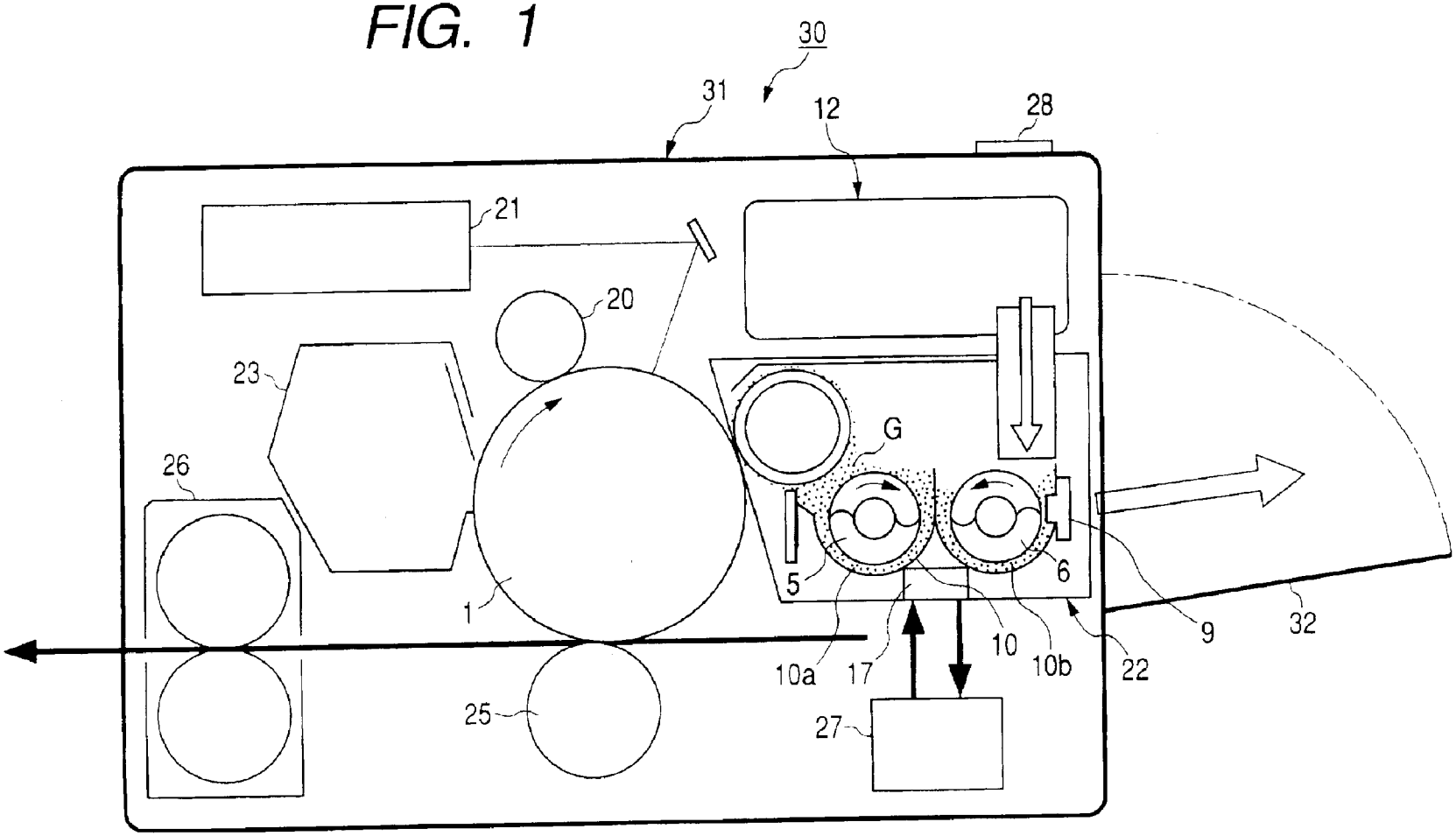
FIG. 1 is a schematic front cross-sectional view of a printer which is an image forming apparatus according to an embodiment of the present invention.
Figure 2:
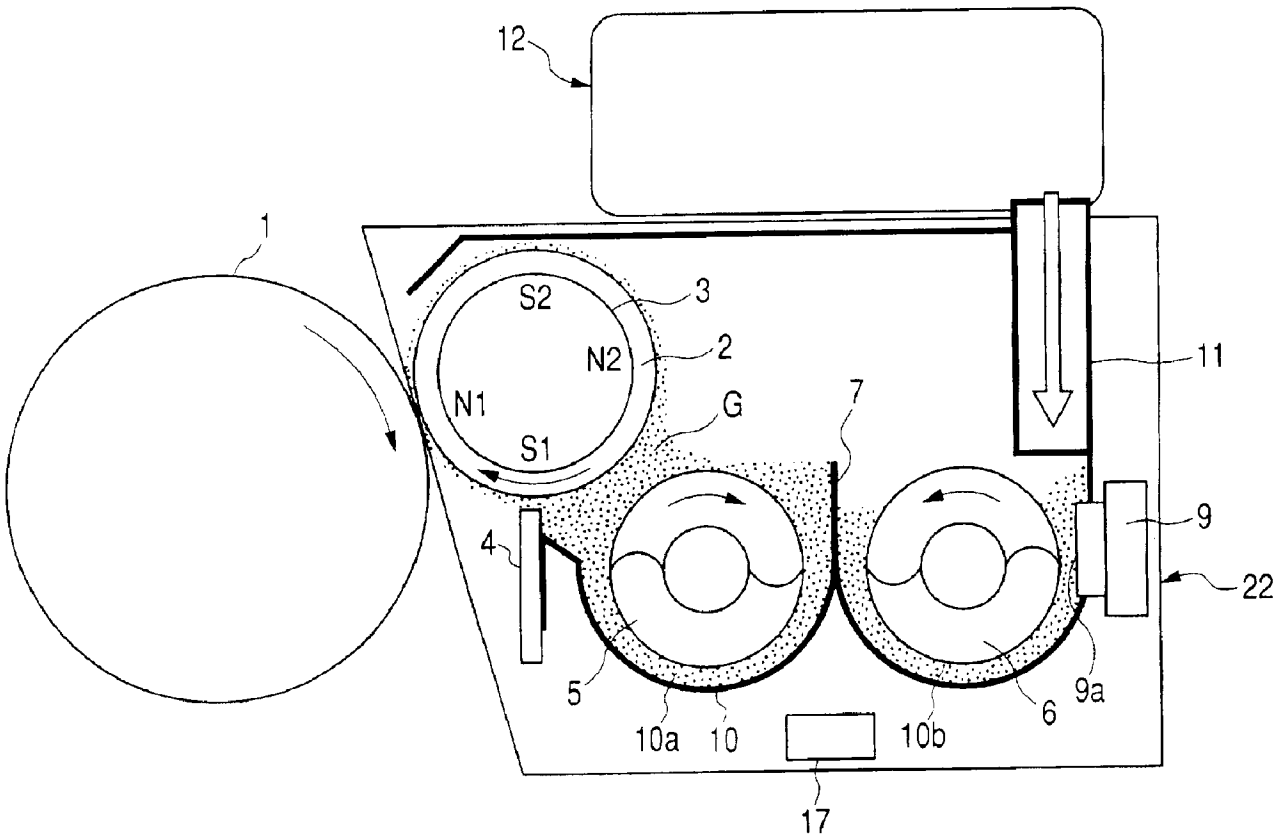
FIG. 2 is a schematic front cross-sectional view of a developing apparatus incorporated in the printer of FIG. 1.

A printer which is an image forming apparatus according to an embodiment of the present invention will hereinafter be described with reference to the drawings. Numerical values taken up in the present embodiment are reference numerical values and do not restrict the present invention.

In the printer 30, a photosensitive drum 1 which is an image bearing member is adapted to bear a latent image thereon. The photosensitive drum 1 has an outer diameter of about 30 mm and is adapted to be rotated in the direction arrow at a peripheral speed of about 100 mm/s. A charging device 20 is adapted to charge the photosensitive drum 1. An exposure device 21 is adapted to form a latent image on the photosensitive drum 1. A developing apparatus 22 is adapted to visualize the latent image on the photosensitive drum 1 with a toner.

A toner supplying apparatus 12 is adapted to supply the toner into the developing apparatus 22. A transferring device 25 which is transferring means is adapted to transfer the visualized toner image onto a transfer material. A fixing device 26 is adapted to fix the toner image transferred onto the transfer material by applying heat and pressure to the transfer material. A cleaning apparatus 23 is adapted to remove any untransferred toner residual on the photosensitive drum 1.

The developing apparatus 22 has a developer container 10. The interior of the developer container 10 is comparted into a developing chamber 10*a* having therein a developer conveying member (hereinafter referred to as the "developing screw") 5 most proximate to a developing sleeve 2, and an agitating chamber 10*b* having a developer conveying member (hereinafter referred to as the "agitating screw") 6 therein.

The developing screw 5 has a shaft diameter of about 6 mm and the outer diameter of the fin thereof is about 13 mm, and it is adapted to be rotated in the direction of arrow at a number of revolutions about 250 rpm. The agitating screw 6 which is developer conveying means has an outer diameter of about 14 mm and is adapted to be rotated in the direction of arrow at a number of revolutions about 300 rpm. Also, the agitating screw 6 has a rib between the fins thereof. The outer diameter of the rib is about 11 mm.

A developer G comprising a mixture of a toner and a magnetic carrier is contained in the developing chamber 10*a* and the agitating chamber 10*b*. The developing apparatus 22 is a process cartridge made into a unit detachably mountable on the main body 31 of the printer 30. The developing apparatus is adapted to be capable of mounted and dismounted with respect to the main body 31 by the door 32 of the main body 31 being opened and closed.

As the toner, use is made of a conventional one comprising binder resin and a colorant, a charging control agent, etc. added thereon. The volume average particle diameter of the toner should preferably be about 5 m to about 15 m.

On the other hand, as the magnetic carrier, use is made of magnetic material particles such as ferrite. Besides, as the magnetic carrier, use can be made of one having a very this resin coating provided on the surfaces of magnetic material particles, or the like. The volume average particle diameter of the magnetic carrier should preferably be about 5 m to about 70 m.

The toner supplying apparatus 12 is disposed above the agitating chamber 10*b*. A non-magnetic toner for replenishment is contained in the toner supplying apparatus 12. A supply port 11 is provided in a side of the developer container 10. Through this supply port 11, an amount of toner corresponding to the amount of toner consumed by development is adapted to fall and be supplied from the toner supplying apparatus 12 to the developing apparatus 22. The toner in the toner supplying apparatus 12 is adapted to be supplied in a proper amount at any time in conformity with the demand of an engine controller 27 which is control means for the replenishment toner.

In the agitating chamber 10*b*, there is installed a developer toner density detecting portion (hereinafter referred to as the "permeability sensor") 9 for detecting the toner density of the developer G from a variation in permeability. The permeability sensor 9 serves also as a developing apparatus failure detecting portion for detecting the failure of the developing apparatus 22.

The measuring surface of the permeability sensor 9 is located in the agitating chamber 10*b* in opposed relationship with the agitating screw 6. The distance between the measuring surface 9*a* of the permeability sensor 9 and the outer diameter of the fin of the agitating screw 6 is about 0.5 mm. The agitating screw 6 is adapted to be rotated to thereby convey the developer. Accordingly, the bulk density of the developer near the measuring surface of the permeability sensor 9 fluctuates with the rotation of the agitating screw 6. Consequently, the output voltage value detected from the permeability sensor 9 fluctuates with the rotation of the agitating screw 6. Therefore, the output voltage value detected from the permeability sensor 9 is averaged and the average value is used as an output voltage. As regards the output voltage in the present embodiment, as an example, the average value of the output voltage value detected from the permeability sensor 9 with one full rotation of the agitating screw is used as an output voltage value. Design is made such that when this average value deviates from a certain range of value, the toner supply apparatus 12 effects the stoppage of the supply of the toner. Also, when the average value of the output voltage exceeds a voltage value corresponding to the absence of the toner, a signal for warning of the absence of the toner is outputted from the engine controller 27 which is control means. This average value is not a value used to detect the abnormal state of the developing apparatus 22, but is used to judge whether the toner is to be supplied or not, to the last.

As a storage apparatus 17 installed in the developing apparatus 22, use is made of EEPROM which is a non-volatile memory capable of reading and writing. The non-volatile memory is not limited to the EEPROM, but may be a ferroelectric memory (FeRAM), a magnetic storage medium or the like. The storage apparatus 17 is electrically connected to the engine controller 27 by the developing apparatus 22 being set in the main body 31 of the printer 30, and is adapted to be capable of reading and writing the information of the developing apparatus 22 from the engine controller 27 of the main body 31 of the printer 30.

Figure 6:
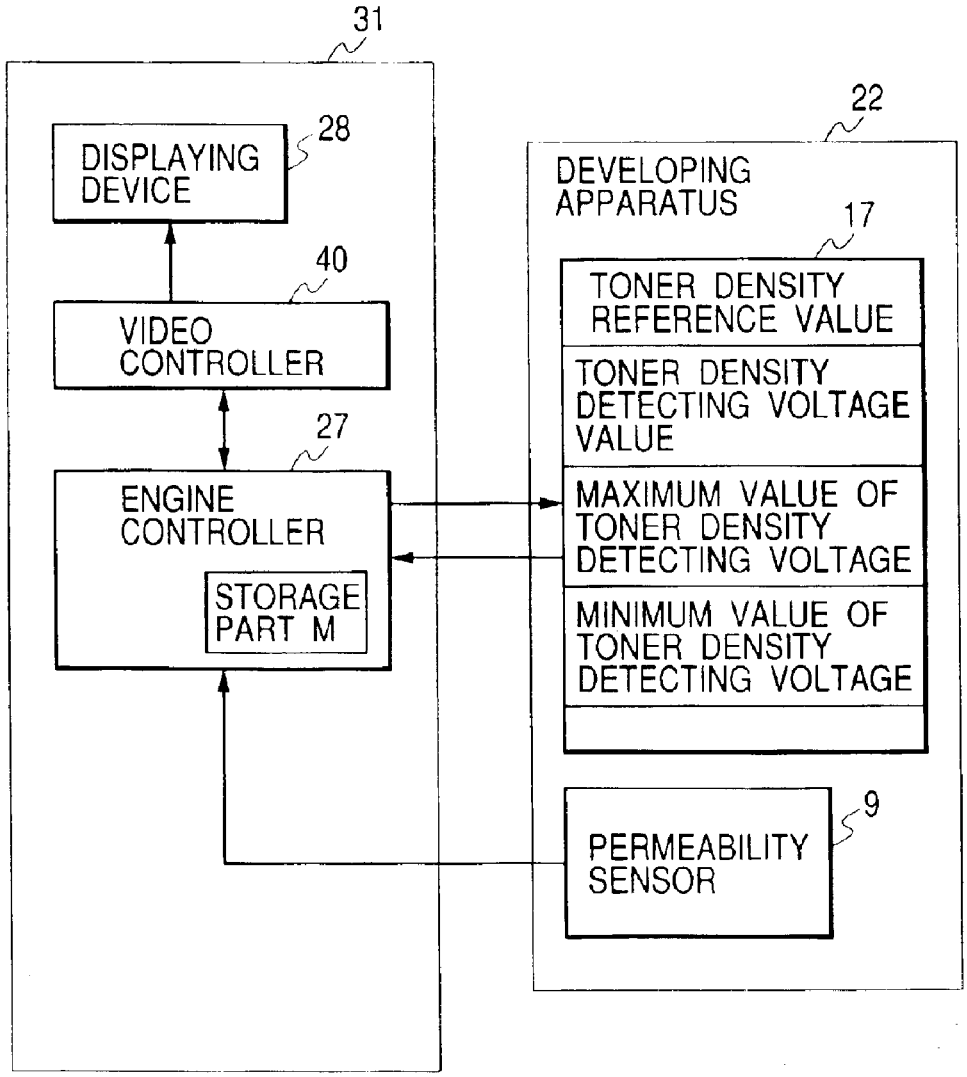
FIG. 6 is a control block diagram of the embodiment of the present invention.

FIG. 6 shows the relation between the engine controller 27 and the storage apparatus 17 of the developing apparatus. The storage apparatus 17 is adapted to store therein a toner density reference value (standard value) stored during the initial installation of the developing apparatus 22, a toner density reference value (standard value) after the reference value (standard value) of the toner density has been corrected in conformity with the number of printed sheets, an arbitrary developer density detecting voltage value, etc. Also, these kinds of information may be stored in a storage part (memory part) M in the engine controller 27. As the storing part M, use is made of one capable of temporarily storing data therein, such as EEPROM which is a non-volatile memory. The engine controller 27 executes the control of the toner supply to the developing apparatus in conformity with the output voltage value from the permeability sensor 9 and the information stored in the storage apparatus 17 or the memory part M.

An opening portion is provided at a region of the developer container 10 which is proximate and opposed to the photosensitive drum 1. In this opening portion, there is provided a developing sleeve 2 which is a developer bearing member formed of a nonmagnetic metal such as aluminum or nonmagnetic stainless steel.

The developing sleeve 2 is provided around a magnet 3 and has an outer diameter of about 16 mm and is adapted to be rotated in the direction of arrow at a peripheral speed of about 200 mm/s to thereby convey the developer G comprising a mixture of the toner and the carrier to the developing portion. A thin developer layer regulated and formed by a developer layer thickness regulating blade 4 becomes a magnetic brush in the developing portion and contacts with the photosensitive drum 1 rotated in the direction arrow, and develops the electrostatic latent image on the photosensitive drum 1.

Figure 3:
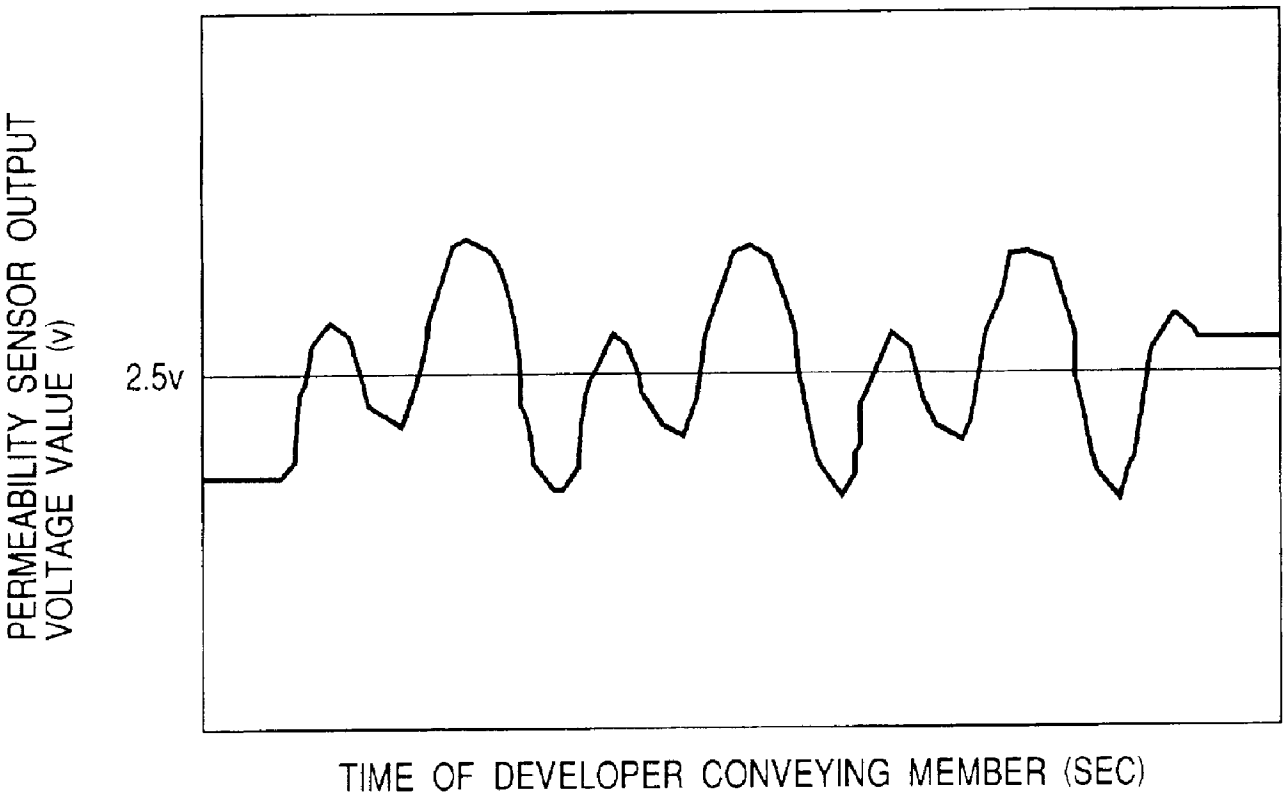
FIG. 3 is an object voltage value waveform graph of a permeability sensor when the developing apparatus is operating normally.

FIG. 3 shows an output (voltage value) waveform from the permeability sensor 9 during a normal time. The output (voltage value) waveform of the permeability sensor 9 is obtained on the basis of the rotation period of the agitating screw 6 rotated and conveying the developer.

That is, when the fin of the agitating screw 6 comes closest to the measuring surface 9*a* of the permeability sensor 9, the bulk density of the developer near the measuring surface of the permeability sensor 9 becomes greatest and the output voltage value thereof becomes maximum. When the portion between the fins of the agitating screw 6 is positioned on the measuring surface 9*a* of the permeability sensor 9, the bulk density of the developer near the measuring surface of the permeability sensor 9 becomes smallest and the output voltage value thereof becomes minimum. When the rib between the fins of the agitating screw 6 comes close to the measuring surface 9*a* of the permeability sensor 9, the bulk density of the developer near the measuring surface of the permeability sensor 9 becomes somewhat great and the output voltage value thereof exhibits a medium value.

In the present embodiment, the average value of the output voltage value detected from the permeability sensor 9 is set so as to be about 2.5 v. It has been found from the result of an experiment that the output voltage value detected from the permeability sensor 9 in the various states of the developer is about 3.1 v to about 3.3 v as a maximum value and is about 1.7 v to about 2.0 v as a minimum value.

Figure 4:
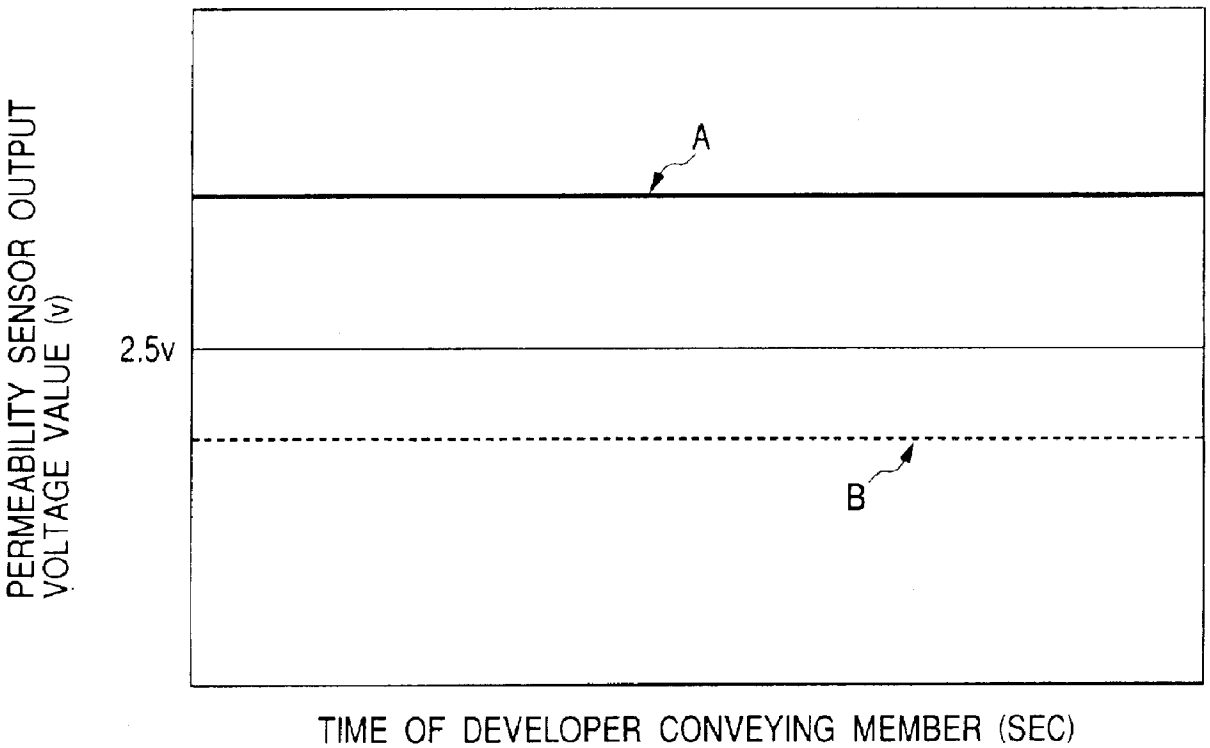
FIG. 4 is an output voltage value waveform graph of the permeability sensor when the developing apparatus or the drive transmitting means of the printer has gone wrong.

FIG. 4 shows an output waveform from the permeability sensor 9 when the developing apparatus 22 has gone wrong. When the developing apparatus 22 goes wrong, the agitating screw 6 is not rotated. Therefore, there is no fluctuation in the bulk density of the developer near the measuring surface 9*a* of the permeability sensor 9 and thus, the output voltage value of the permeability sensor 9 exhibits a constant arbitrary value.

Solid line A in FIG. 4 indicates the output voltage value of the permeability sensor 9 when the agitating screw 6 has effected one full rotation during the failure of the developing apparatus 22, and this output voltage value indicates a value greater than about 2.5 v which is the average value of the output voltage value. That is, it indicates the output value when the fins and rib of the agitating screw 6 are stationary near the measuring surface 9*a* of the permeability sensor 9.

In this case, the permeability sensor 9 erroneously detects that the toner density of the developer is low, and informs the engine controller 27 of it and therefore, the engine controller 27 controls the toner supplying apparatus 12 and causes the toner supplying apparatus 12 to continue to supply the toner into the developer container 10.

Broken line B in FIG. 4 indicates the output voltage value of the permeability sensor 9 when the agitating screw 6 has effected one full rotation when the developing apparatus 22 has gone wrong, and it indicates a value smaller than about 2.5 v which is the average value of the output voltage value. That is, it indicates the output value when the portion between the fins of the agitating screw 6 is stationary while being opposed to the measuring surface 9*a* of the permeability sensor 9.

In this case, the permeability sensor 9 erroneously detects that the toner density of the developer is high, and informs the engine controller 27 of it and therefore, the engine controller 27 controls the toner supplying apparatus 12 and stops the toner supply into the developer container 10 by the toner supplying apparatus 12.

As described above, the developing apparatus 22 in the present embodiment is designed such that whether the developing apparatus has been brought into its inoperative state by such failure as the damage of gears, not shown, which are the drive transmitting means of the developing apparatus, the locking of the bearing portion of the developing sleeve 2 which is a developer bearing member, the locking of the bearing portion of the developing screw or the locking of the bearing portion of the agitating screw, or the failure of a developing apparatus driving motor, not shown, which is the drive transmitting means of the main body of the printer can be detected on the basis of the difference in the fluctuation of the output voltage detected by the permeability sensor 9.

Figure 5:
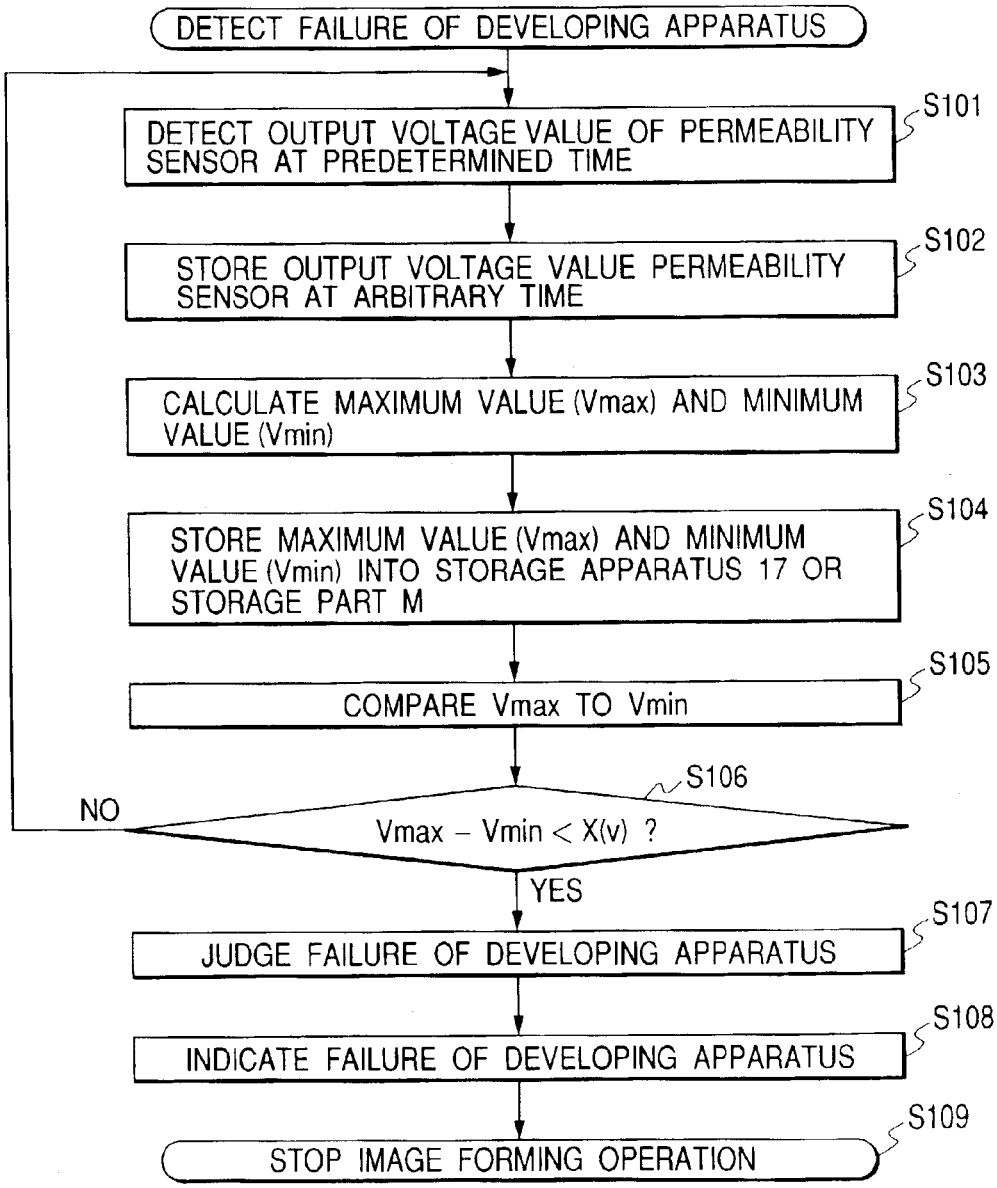
FIG. 5 is a flowchart illustrating the failure detecting operation of the developing apparatus.

FIG. 5 is a flowchart for illustrating the operation of detecting the failure of the developing apparatus 22. The output voltage value of the permeability sensor 9 is detected at a predetermined time (S101), and the output voltage value from the permeability sensor 9 at an arbitrary time (about 10 seconds in the present embodiment) is stored in the storage apparatus 17 or the memory part M in the engine controller 27 (S102). The maximum value Vmax(v) and minimum value Vmin(v) of the output voltage are calculated (S103), and are stored in the storage apparatus 17 or the memory part M in the engine controller 27 (S104).

The engine controller 27 compares the maximum value Vmax(v) and the minimum value Vmin(v) with each other (S105), and when the expression that $Vmax-Vmin < X(v)$ is satisfied (S106), it judges the failure of the developing apparatus (S107), and indicates the failure of the developing apparatus on a displaying portion 28 (S108), and stops the operation of the printer 30 (S109). X(v) is a threshold value for judging the failure.

According to the result of the experiment, it is desirable that the value of X(v) be about 0.3(v). However, particularly, depending on the construction of the vicinity of the permeability sensor 9, even if the value of X(v) is about 1(v) to 1.0(v), whether the developing apparatus 22 has gone wrong, i.e., malfunctioned, can be sufficiently detected.

While in the above-described embodiment, in effecting the detection of the failure of the developing apparatus 22, the engine controller 27 is adapted to calculate the maximum value and minimum value of the detected voltage value from an output voltage value obtained during an arbitrary time (e.g. about 10 seconds) on the basis of the output voltage value from the permeability sensor 9, this is not restrictive. Design may be made such that the aforementioned maximum value and minimum value are calculated from an arbitrary number of (10 in the present embodiment) output voltage values while the agitating screw 6 effects one full rotation.

Also, the above-mentioned predetermined time is the time when it is detected that the agitating screw 6 has been rotated each time printing is executed, but may be the time when it is detected that the power supply switch of the printer 30 has been closed. Further, it may be the time when it is detected that the door 32 of the main body 31 of the printer 30 has been opened and closed. Simultaneously with the closing of the power supply switch of the printer 30, the power supply switch of the developing apparatus 22 is also closed.

While design is made such that failure is indicated on the displaying portion 28, design may be made such that a signal indicating of failure is outputted to a video controller 40 for controlling data communication with an external apparatus such as the host computer of FIG. 6 so that the failure may be indicated on the displaying portion or the like of the host computer.

Also, the developing apparatus in the present embodiment may adopt a construction provided with the function of again effecting the judgment of the failure of the developing apparatus when the failure of the developing apparatus has been detected. That is, the developing apparatus in the present embodiment may be designed such that after the operation of judging whether the developing apparatus has gone wrong is performed a plurality of times, final judgment as to whether the developing apparatus has gone wrong is passed. For example, even when the detection of failure is once effected on the basis of the flow chart of FIG. 5 and the maximum value and minimum value of the output voltage value from the permeability sensor 9 are compared with each other and as a result, failure is detected, failure is not immediately judged, but the developing sleeve and the agitating screw are rotated for an arbitrary time and the control of FIG. 5 is executed again, and when failure is detected as a result, the developing device may be judged to have gone wrong. Thereby, the accuracy of the detection of failure can be further improved and the detection of the failure of the developing apparatus can be accomplished more reliably.

As described above, in the developing apparatus 22 in the present embodiment, the fluctuation of the output voltage detected at a predetermined time by the permeability sensor 9 which is developer toner density detecting means with the rotation of the agitating screw 6 which is developer conveying means rotated to thereby convey the developer can be detected to thereby reliably and early detect the failure of the drive transmitting means of the developing apparatus and the drive transmitting means on the main body 31 side of the printer. Also, the construction becomes simple and can be made inexpensive.

The developing apparatus for the image forming apparatus of the present invention can detect the failure of the drive transmitting means of the developing apparatus reliably and early.

The image forming apparatus of the present invention can detect the failure of the drive transmitting means of the main body thereof early. Moreover, it is provided with the developing apparatus which can detect failure early and therefore can prevent the waste of the toner occurring during failure and a bad image such as fogging in which the toner adheres to a non-image portion and the scattering of the toner.

While in the above-described embodiment, description has been made of a construction using a permeability sensor to measure the density of the developer, the density of the developer may be measured by using, as a system for detecting the density of the developer, for example, a toner density detecting apparatus by an optical sensor utilizing the fact that the light reflectance (or the transmittance) of the developer is varied by toner density, or a toner density detecting apparatus for detecting any variation in the light reflectance of a predetermined patch image formed on an image bearing member under a predetermined condition and indirectly estimating the toner density of the developer, or the like. In case where the optical sensor is used, not only when use is made of a developer including a toner and a carrier, but also when only a toner is used as a developer (monocomponent developer), it becomes possible to measure the toner density thereof.

It is to be understood that the form of may invention herein shown and described is to be taken as a preferred example of the same and that various charges in the shape size and arrangement of parts may be resorted to without departing from the spirit of my invention or the scope of the subjoined claims.

What is claimed is:

1. An image forming apparatus comprising:

a developing device including a developer container for containing therein a developer including a toner, a developer agitating member for rotating and circulating the developer in the developer container, and density detecting means for detecting a permeability of the developer in the developer container to thereby detect a toner density, wherein the density detecting means detects a toner density two or more times while the developer agitating member rotates by a predetermined number of revolutions; and control means for controlling a density of the toner in the developer container on the basis of the toner density detected by the density detecting means, wherein the control means outputs a signal, which indicates a failure of the developing device when a value of a difference between a maximum value and a minimum value of the toner density detected by the density detecting means is smaller than a predetermined value.

2. An image forming apparatus according to claim 1, wherein the control means outputs a signal, which indicates the failure of the developing device on the basis of the toner density detected at a predetermined time by the density detecting means.

3. An image forming apparatus according to claim 1, wherein the control means averages the toner density detected by the density detecting means.

4. An image forming apparatus according to claim 2, wherein the predetermined time is a time when a detection is made that a power supply of a main body of the image forming apparatus has been turned on.

5. An image forming apparatus according to claim 2, wherein the predetermined time is a time when a detection is made that a door of a main body of the image forming apparatus has been opened and closed.

6. An image forming apparatus according to claim 2, wherein the predetermined time is a time when image forming is being executed.

7. An image forming apparatus according to claim 1, wherein the developing device is detachably mounted on the image forming apparatus.

8. An image forming apparatus comprising:

a developing device including a developer container containing a developer therein, a developer agitating member for rotating and circulating the developer in the developer container, and density detecting means for detecting a developer density of the developer in the developer container, wherein the density detecting means detects the developer density two or more times while the developer agitating member rotates by a predetermined number of revolutions; and control means for controlling the density of the developer in the developer container on the basis of the developer density detected by the density detecting means, and wherein the control means outputs a signal, which indicates a failure of the developing device when a value of a difference between a maximum value and a mimimum value of the developer density detected by the density detecting means is smaller than a predetermined value.

9. An image forming apparatus according to claim 8, wherein the control means outputs a signal, which indicates the failure of the developing device on the basis of the developer density detected at a predetermined time by the density detecting means.

10. An image forming apparatus according to claim 8, wherein the control means averages the toner density detected by the density detecting means.

11. An image forming apparatus according to claim 9, wherein the predetermined time is a time when a detection is made that a power supply of a main body of the image forming apparatus has been turned on.

12. An image forming apparatus according to claim 9, wherein the predetermined time is a time when a detection is made that the door of a main body of the image forming apparatus has been opened and closed.

13. An image forming apparatus according to claim 9, wherein the predetermined time is a time when image forming is being executed.

14. An image forming apparatus according to claim 8, wherein the developing device is detachably mountable on the image forming apparatus.

15. A control method of controlling an image forming apparatus including:

a developing device including a developer container for containing therein a developer including a toner, a developer agitating member for rotating and circulating developer in the developer container, density detecting means for detecting a permeability of the developer in the developer container to thereby detect a toner density; and control means for controlling the density of the toner in the developer container on the basis of the toner density detected by the density detecting means;

the control method comprising the steps of:

detecting the toner density two or more times while the developer agitating member rotates by a predetermined number of revolutions; and outputting a signal, which indicates a failure of the developing device when a value of a difference between a maximum value and a minimum value detected in the step of detecting a toner density in the developer container is smaller than a predetermined value.

16. A control method according to claim 15, further comprising a step of indicating that the developing device has malfunctioned.

17. A control method of controlling an image forming apparatus including:

a developing device having a developer container containing a developer therein, density detecting means for detecting a developer density in the developer container, a developer agitating member for rotating and circulating the developer in the developer container, and control means for controlling the density of the developer in the developer container on the basis of the developer density detected by the density detecting means, the control method comprising the steps of:

detecting the developer density two or more times the developer agitating member rotates by a predetermined number of revolutions; and outputting a signal, which indicates failure of the developing device when a value of a difference between a maximum value and a minimum value of the developer density detected by the density detecting means is smaller than a predetermined value.

18. A control method according to claim 17, further comprising a step of indicating that the developing apparatus has malfunctioned.

* * * * *

UNITED STATES PATENT AND TRADEMARK OFFICE

CERTIFICATE OF CORRECTION

PATENT NO. : 6,947,677 B2
DATED : September 20, 2005
INVENTOR(S) : Masao Uyama et al.

It is certified that error appears in the above-identified patent and that said Letters Patent is hereby corrected as shown below:

Title page,
Item [56], References Cited, U.S. PATENT DOCUMENTS,
"6023974 A" should read -- 60-263974 A --; and
"03256082 A" should read -- 3-256082 A --.
Item [57], ABSTRACT,
Line 6, "gone wrong," should read -- malfunctioned, --.

Column 2,
Line 15, "known" should read -- known as --.

Column 3,
Line 56, "goes wrong," should read -- malfunctions, --.

Column 5,
Line 41, "comparted" should read -- compartmentalized --; and
Line 62, "mounted" should read -- being mounted --.

Column 6,
Line 5, "this" should read -- thin --.

Column 7,
Line 66, "gone wrong," should read -- malfunctions, --; and
Line 67, "goes wrong," should read -- malfunctions, --.

Column 9,
Lines 41 and 42, "gone wrong" should read -- malfunctioned --; and
Line 52, "gone wrong." should read -- malfunctioned. --.

Column 10,
Line 28, "may" should read -- the --; and
Line 32, "my" should read -- the --.

Column 11,
Line 24, "and" should be deleted.

UNITED STATES PATENT AND TRADEMARK OFFICE

CERTIFICATE OF CORRECTION

PATENT NO. : 6,947,677 B2
DATED : September 20, 2005
INVENTOR(S) : Masao Uyama et al.

It is certified that error appears in the above-identified patent and that said Letters Patent is hereby corrected as shown below:

Column 12,
Line 40, “times” should read -- times while --; and
Line 49, “apparatus” should read -- device --.

Signed and Sealed this

Twenty-first Day of February, 2006

JON W. DUDAS
*Director of the United States Patent and Trademark Office*